United States Patent [19]

Heenan

[11] 4,227,772

[45] Oct. 14, 1980

[54] PAVEMENT MARKER

[75] Inventor: Sidney A. Heenan, Park Ridge, Ill.

[73] Assignee: Amerace Corporation, New York, N.Y.

[21] Appl. No.: 789,265

[22] Filed: Apr. 20, 1977

Related U.S. Application Data

[63] Continuation-in-part of Ser. No. 681,859, Apr. 30, 1976, abandoned.

[51] Int. Cl.[3] ..... G02B 5/124

[52] U.S. Cl. ..... 350/103; 350/97

[58] Field of Search ..... 350/103-105, 350/97, 106, 109; 404/14, 15, 12, 16

[56] References Cited

U.S. PATENT DOCUMENTS

| | | | |
|---|---|---|---|
| 3,409,344 | 11/1968 | Balint et al | 350/103 |
| 3,485,148 | 12/1969 | Heenan | 404/12 |
| 3,627,403 | 12/1971 | Hedgewick | 350/103 |
| 3,836,275 | 3/1972 | Finch | 404/13 |
| 3,954,324 | 5/1976 | Arnott et al. | 350/109 |
| 3,980,410 | 9/1976 | Suhr et al. | 404/16 |
| 4,025,159 | 5/1977 | McGrath | 350/105 |
| 4,035,039 | 7/1977 | De Master | 350/97 |

*Primary Examiner*—John K. Corbin
*Assistant Examiner*—B. W. de los Reyes
*Attorney, Agent, or Firm*—Ronald A. Sandler; S. Michael Bender

[57] ABSTRACT

A low-profile pavement marker includes a base of an opaque, light-diffusing synthetic resin having at least one support wall positioned in use in the direction of an oncoming vehicle, and having a plurality of inwardly extending recesses defining adjacent pockets therein. A lens member of light-transmitting synthetic resin, rigidly secured to the base, has a peripheral edge portion intersected by a plurality of dividing portions for dividing the lens member into a plurality of areas respectively overlying and coextensive with the pockets formed in the support wall, the dividing portions and the edge portion being sealed to the support wall to provide a plurality of independent and hermetically sealed cells thereon. The lens member has a plurality of retrodirective cube-corner-type reflector elements extending beyond the dividing portions and the edge portion and into the cells and oriented to render the reflector structure highly visible at night. The base and the support wall and the lens member in the areas corresponding to the dividing portions and the edge portion reflect daylight to render the marker highly visible in daylight. An adhesive impact-absorbing material fixedly secures the pavement marker to the roadway and reduces the impact energy imparted by vehicles to the marker and to the roadway.

A snowplowable version of the pavement marker is disclosed, as well as two embodiments of abrasion-resistant constructions. Construction of the base and lens member of rubber-modified methyl methacrylate is also disclosed.

17 Claims, 24 Drawing Figures

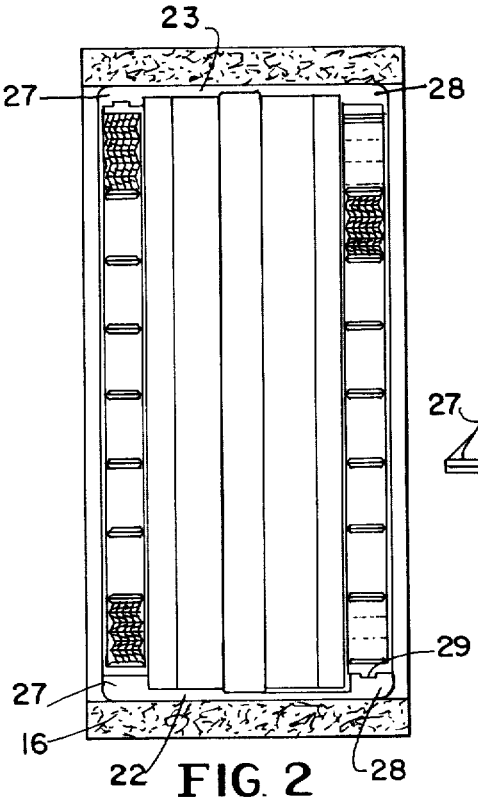
FIG. 2
FIG. 1
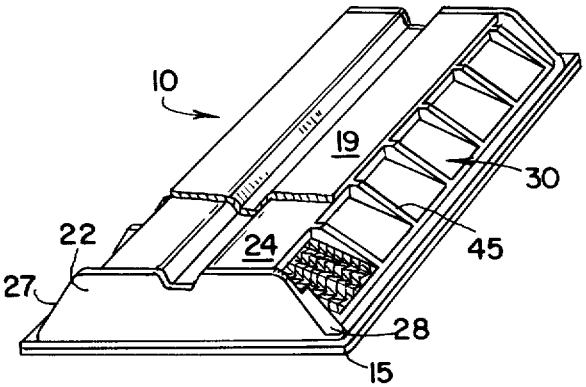
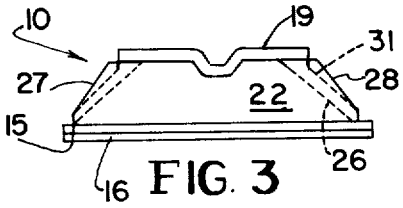
FIG. 3
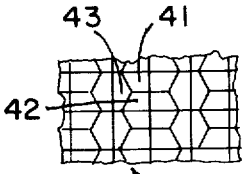
FIG. 4A
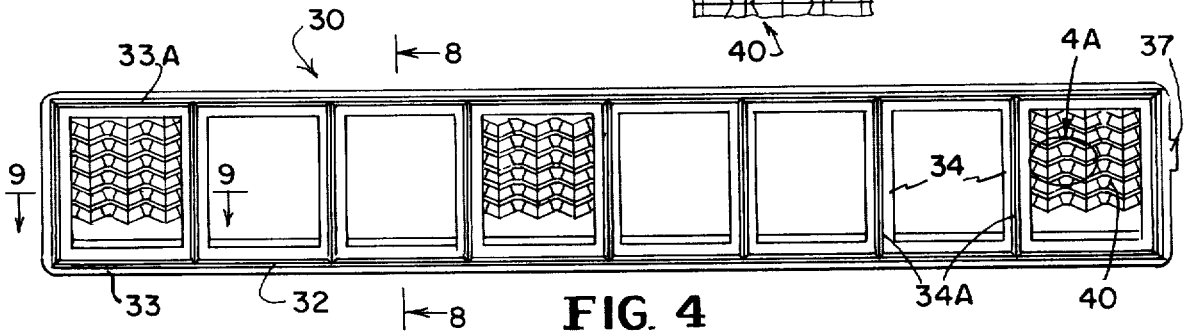
FIG. 4

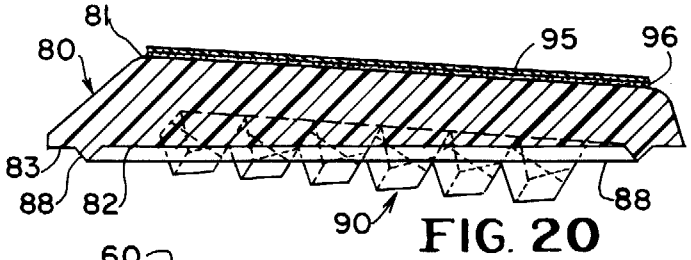
FIG. 20
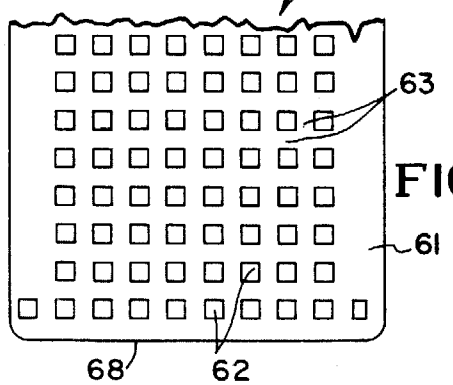
FIG 18
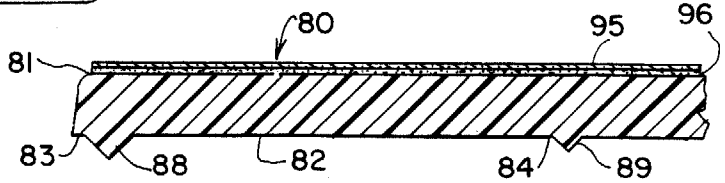
FIG. 21
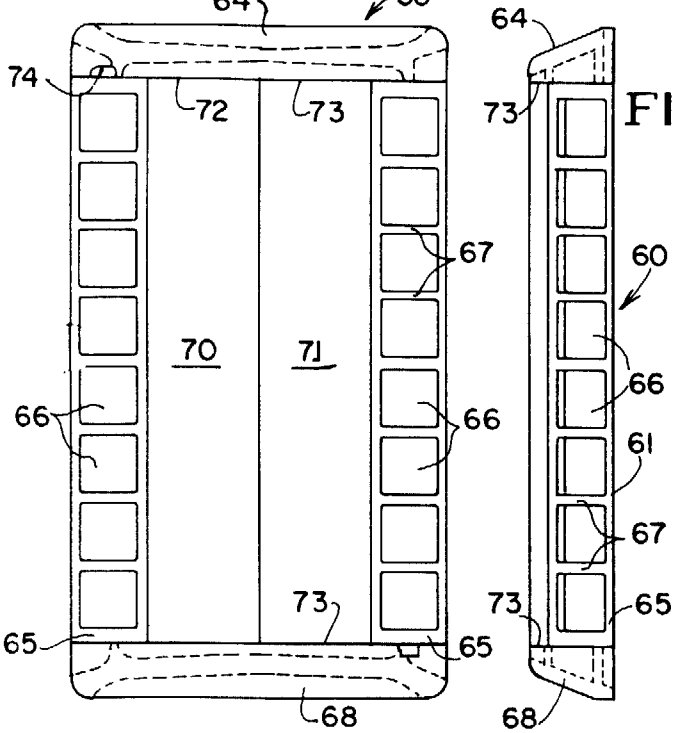
FIG. 17
FIG. 16
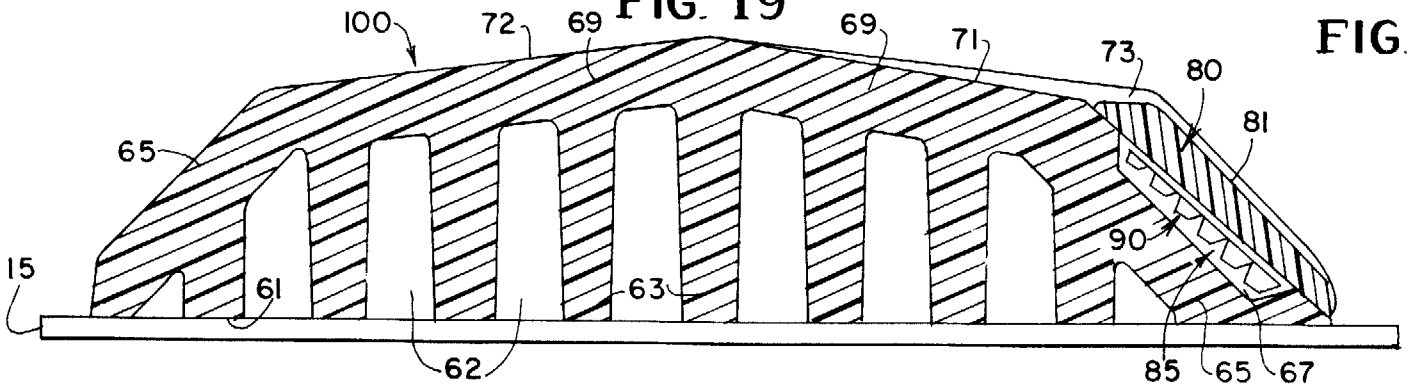
FIG. 19

PAVEMENT MARKER

RELATED APPLICATION

This is a continuation-in-part of my copending application Ser. No. 681,859, filed Apr. 30, 1976 now abandoned.

BACKGROUND OF THE INVENTION

In applicant's prior U.S. Pat. No. 3,332,327, there is disclosed a pavement marker adapted to be placed on highways and in which the pavement marker front face is inclined at a predetermined angle to the roadway surface so that a self-cleaning effect is provided by virtue of that predetermined angle, whereby that pavement marker achieves initial high optical efficiency and the optical deterioration arising out of contact with tires of oncoming vehicles is substantially reduced by allowing the face to be periodically wiped clean by contact with such vehicles. In addition, there is disclosed in that patent a cube-corner reflex reflective optical system in which the cube axes of the cube-corner reflective elements are inclined so as to be substantially coincidental with the nominal incoming refracted ray. Pavement markers made in accordance with the '327 patent and similar to the structure disclosed therein have been extremely successful in operation, and several millions of them have been installed, primarily in areas where no snowplowing of the roads is required. That earlier pavement marker, while highly effective as a nighttime signal, is substantially ineffective as a daytime marker, because of the nature of its construction, and, in particular, the large metallized area of the reflective portion thereof, which metallizing is required because of the epoxy fill. Also, the height of the earlier pavement marker precluded its practical use under snowplow conditions.

Furthermore, the '327 marker involves a tradeoff between abrasion-resistance and self-cleaning or wiping characteristics whereby given the materials used there are limits to the improvement that can be made in one quality without adversely affecting the other.

Also, where a road is constructed of a particular material, or is newly installed asphalt, the '327 marker has caused deterioration of the road surfaces. Some users have recommended delaying installation of such markers for a year to allow the road to cure. In an attempt to overcome these problems caused by unsatisfactory road surfaces or newly installed surfaces, the '327 markers were installed with an impact-absorbing pad. However, the use of the impact-absorbing material still did not completely resolve the problem.

In applicant's prior U.S. Pat. No. 3,833,285, issued Sept. 3, 1974, there is disclosed an optical system for use with cube-corner-type reflectors, wherein the reflectivity of the reflector is increased by enlarging one of the three dihedral angles forming the cube-corner element, thereby improving the visibility of the reflector at a selected wider observation angle. Applicant presently has on file a United States Application Ser. No. 753,132, filed Dec. 22, 1976, a continuation of application Ser. No. 625,723, now U.S. Pat. No. 4,032,319 filed Mar. 24, 1967, which discloses a cellular system for reflectors in which, in one embodiment, a cellular reflector member is provided on an underlying metal casting for providing a snowplow-type marking. That reflector design is capable of increased daylight reflectivity. Applicant also is aware of pavement markers used on the roadway and put out by Ray-O-Lite, Inc., of Huntington Beach, California, and identified on the shell thereof as a model "FLD", in which three substantially large cells are provided, the cells being provided by walls which extend beyond the apices of the cube-corner elements and in which the lens member is affixed to a substantially flat support wall lying thereunder. These prior markers presented an undesirable high profile and other disadvantages.

SUMMARY OF THE INVENTION

Applicant, while utilizing some of the features disclosed in the aforementioned prior art, has provided a novel structure which is capable of providing substantially improved daytime and nighttime visibility in a durable pavement marker having several advantages over those disclosed.

It is an object of the present invention to provide an improved, low-profile pavement marker which is substantially more durable and provides greater daytime and nighttime reflectivity than existing forms of pavement markers.

It is another object of the present invention to provide a low-profile pavement marker in which the maximum height of the marker above the roadway surface does not exceed about 0.55 inches, thereby reducing the impact energy imparted to the marker and to the underlying roadway surface.

It is a further object of the present invention to provide a low-profile pavement marker in which the reflective portions thereof are provided in a plurality of hermetically sealed cells so that in the event of damage or destruction to one of the cells, the pavement marker can still effectively function to provide continued sufficient reflectivity.

It is a further object of the invention to provide a low-profile pavement marker which can be installed directly on the roadway and which also is capable of use with a metal casting or other housing, whereby the pavement marker also can be used in areas which are frequently heavily snowplowed during the winter months.

It is a further object of the invention to provide a low-profile pavement marker which, because of its substantially reduced height relative to existing pavement markers, and in cooperation with an impact-absorbing material on the lower surface thereof, minimizes the impact damage to itself and to the underlying roadway surface as vehicles strike the marker and ride over same.

It is a further object of the present invention to provide a low-profile pavement marker having maximum abrasion resistance to vehicles striking the marker, whereby the optical qualities of the face of the reflective portion of the marker are substantially less degraded, thereby increasing the durability and effectiveness of the marker over a longer time period.

Still another object of this invention is the provision of a low-profile pavement marker having improved self-cleaning or wiping characteristics without adverse effect on abrasion resistance.

To the accomplishment of the foregoing and still other objects and advantages, the present invention, briefly summarized, comprises a low-profile pavement marker for providing a marker signal on a roadway surface capable of reflecting daylight falling thereon and for reflecting light back toward the source thereof so as to be visible to a driver in an oncoming vehicle, the pavement marker including a base of an opaque, light-diffusing synthetic resin having a generally horizontal bottom surface, the base having at least one support wall positioned in use in the direction of an oncoming vehicle. The support wall has a plurality of inwardly extending recesses defining adjacent pockets therein. A lens member of light-transmitting synthetic resin is rigidly secured to the base, the lens member having a generally planar front face being so oriented as to make an acute angle of between 15° and 60° with the bottom surface of the base to rise above the roadway surface upon which the pavement marker is to be installed. The lens member has a peripheral edge portion and a plurality of dividing portions intersecting the edge portion and dividing the body member into a plurality of areas overlying and coextensive with the pockets formed in the base, the dividing portions and edge portion being secured to the support wall thereby to provide a plurality of independent and hermetically sealed cells on the support walls. The lens member has a plurality of retrodirective cube-corner-type reflector elements formed therein and extending beyond the dividing portions and the edge portion and into the pockets, the reflector elements being oriented to reflect light impinging upon the front face of said lens member in the areas thereof corresponding to the cells back toward the source thereof to render the reflector structure highly visible at night. The base and the support wall and the lens member in the areas corresponding to the dividing portions and peripheral edge portion, provide a reflector surface for reflecting daylight impinging upon the marker to render it highly visible in daylight.

Furthermore, an adhesive impact-absorbing material is fixedly secured to the bottom surface of the base for adhesively securing the pavement marker to an underlying support surface.

BRIEF DESCRIPTION OF THE DRAWINGS

The invention, together with further objects and advantages thereof, can best be understood by reference to the following specification, taken in connection with the accompanying drawings, in which:

FIG. 1 is a partially sectioned perspective view of one embodiment of a pavement marker constructed in accordance with the present invention;

FIG. 2 is a top plan view of the pavement marker of FIG. 1;

FIG. 3 is an end elevational view of the pavement marker illustrated in FIGS. 1 and 2;

FIG. 4 is an enlarged view of the rear face of a lens member forming part of the pavement marker of the present invention, taken in a direction perpendicular to the rear face thereof;

FIG. 4A is a fragmentary view, on an enlarged scale, of a portion of the rear reflective surface of the lens member within the circle 4A of FIG. 4, but taken in a direction parallel to the cube axis of the elements;

FIG. 16 is a top plan view of the base of the pavement marker of FIG. 11;

FIG. 17 is a side elevational view of the base of FIG. 16, as viewed from the right-hand side thereof;

FIG. 18 is a fragmentary bottom plan view of the base of FIGS. 16 and 17;

FIG. 19 is a greatly enlarged view in vertical section taken along the line 19—19 in FIG. 13;

FIG. 20 is a greatly enlarged view in vertical section taken along the line 20—20 in FIG. 15, and rotated approximately 90°;

FIG. 21 is an enlarged fragmentary sectional view of the lens member of FIG. 15, taken along the line 21—21 therein;

DESCRIPTION OF THE PREFERRED EMBODIMENTS

A pavement marker constructed in accordance with the present invention is shown in pérspective at 10 in FIG. 1 and includes a body or base 20, of an opaque, light-diffusing synthetic resin having mounted thereon two lens members of light-transmitting synthetic resin, each generally designated as 30.

The base 30 is substantially solid and is formed as a one-piece member to provide a durable structure capable of withstanding impact forces applied to the pavement marker when it is struck by a tire of an oncoming vehicle.

The pavement marker 10 is employed to provide a marking on a generally horizontal roadway surface, the marking being visible from an oncoming vehicle on the roadway to delineate traffic lanes and for edge delineation, as is well recognized in the art. In addition, the pavement marker 10 of the present invention may be utilized with metal base members of the type illustrated and claimed in applicant's copending application entitled "Snowplowable Pavement Marker and Method and Apparatus for Installing Same", Ser. No. 681,858 now abandoned, filed Apr. 30, 1976 (Docket No. SP-922), and the continuation-in-part thereof, filed on even data herewith, Ser. No. 789,249 now abandoned (Docket No. SP-922-A), assigned to the same assignee as the present application.

Figure 7:
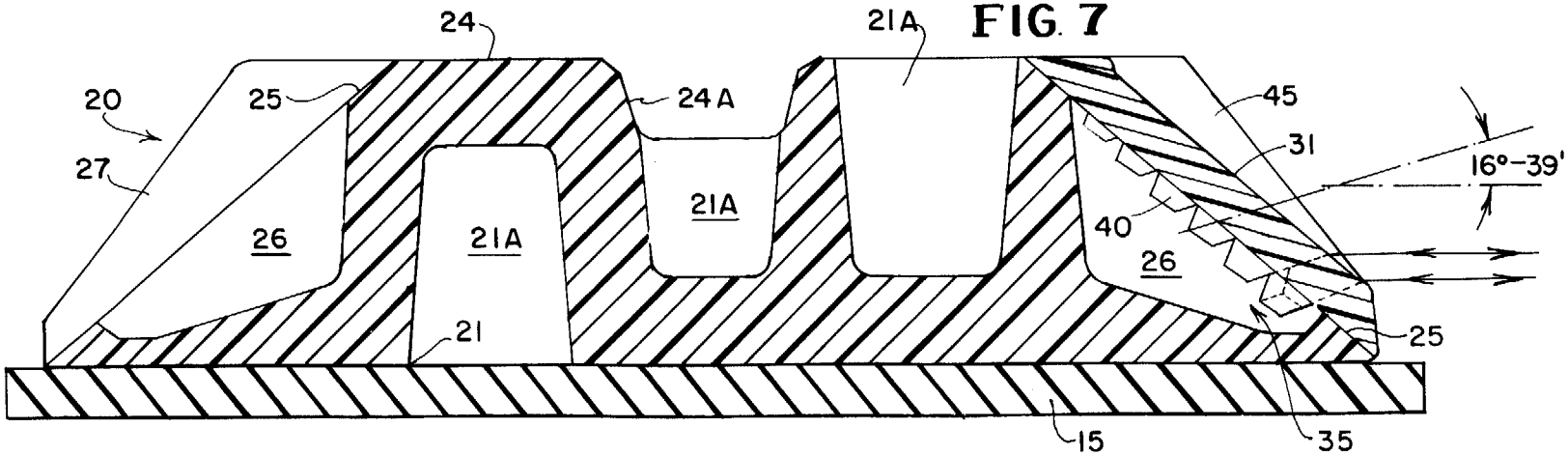
FIG. 7 is a greatly enlarged cross-sectional view of the base, taken along the line 7—7 in FIG. 5, with the lens member of FIG. 4 shown mounted in place on one side of the base.
Figure 6:
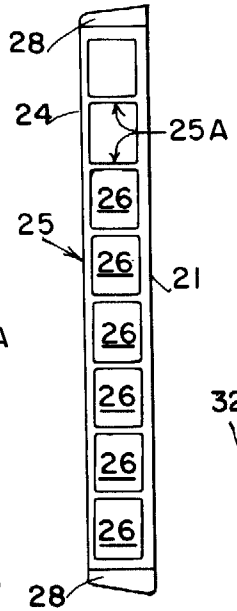
FIG. 6 is a side elevational view of the base of FIG. 5, as viewed from the right-hand side thereof.
Figure 5:
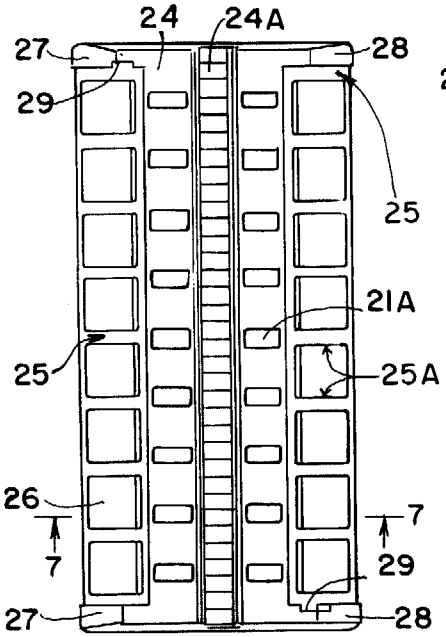
FIG. 5 is a top plan view of the base of the pavement marker of the present invention.
Figure 11:
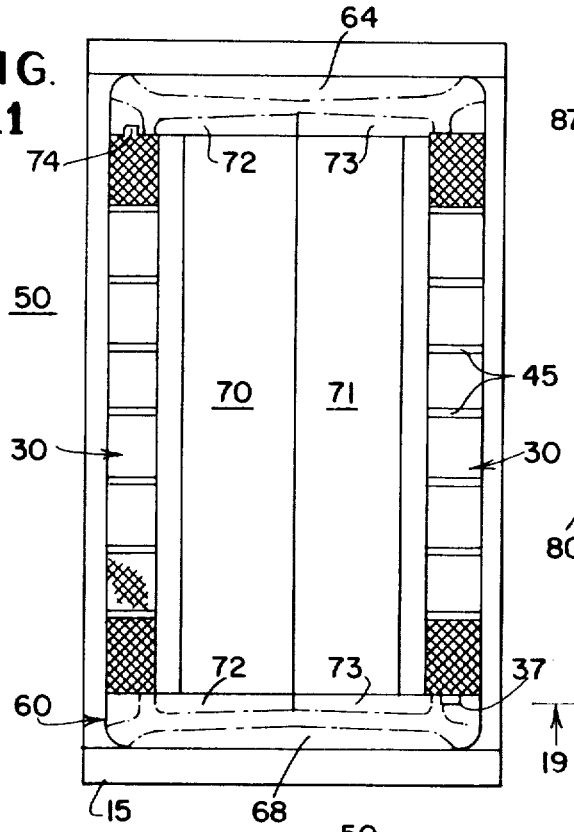
FIG. 11 is a top plan view of a third embodiment of the pavement marker of the present invention.
Figure 13:
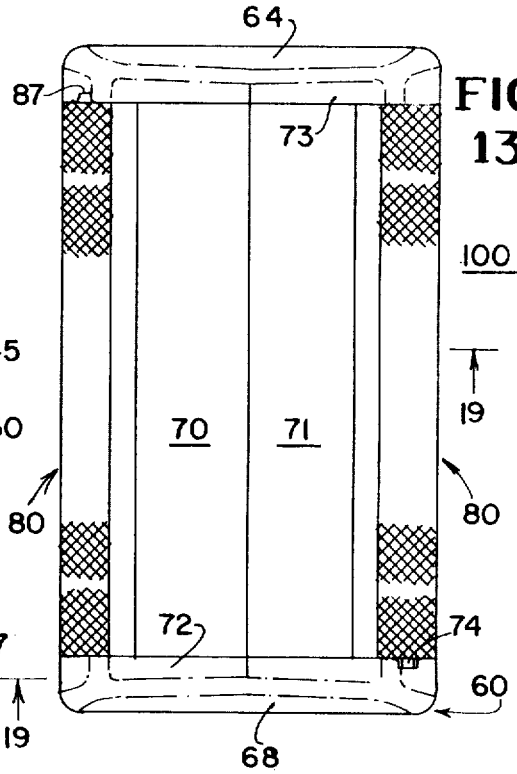
FIG. 13 is a top plan view of a fourth embodiment of the pavement marker of the present invention.
Figure 12:
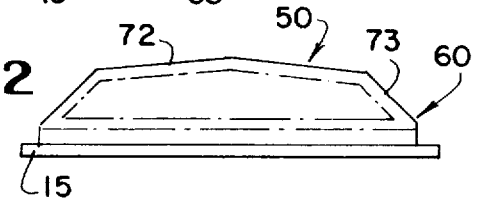
FIG. 12 is an end elevational view of the pavement marker of FIG. 11.
Figure 14:
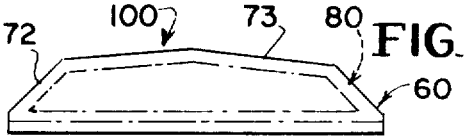
FIG. 14 is an end elevational view of the pavement marker of FIG. 13.

Referring now more particularly to FIGS. 5, 6 and 7, it will be seen that the base 20 has a generally horizontal bottom surface 21. In order to prevent sinks or shrink stresses in molding, the base 20 may be provided with a plurality of molding recesses 21A (FIGS. 5 and 7). The base further includes a pair of generally vertically disposed end walls 22 and 23 (FIG. 2), and a generally horizontal top wall 24 having a rectangular channel 24A extending from one end wall 22 to the opposite end wall 23.

There is provided a pair of inclined support walls 25, disposed at opposite sides of the base 20, and positioned such that in use, they will be facing the direction of oncoming vehicles. Each of these supports walls 25 has a plurality of recesses 26 formed therein, which recesses have substantially rectangular openings intersecting the plane of the wall, the portions of each support wall 25 between the recesses 26 defining partitions or dividing portions 25A. The recesses or pockets 26 and the support wall 25 cooperate with the overlying lens member 30 in a manner hereinafter described.

The base 20 further includes side edges 27 and 28 disposed on the opposite ends of each of the respective end walls 22 and 23, the side edges 27 and 28 extending outwardly beyond the support walls 25, and defining a channel between the opposite side edges and the adjacent support wall 25 disposed therebetween. The base 20 also includes a tab opening 29 formed in the end walls 22 and 23 adjacent to the respective inclined support walls 25 for purposes of facilitating the alignment of the lens member 30 during attachment thereof to the base 20.

The lens member 30 which provides the reflective structure for reflecting light back toward the source thereof, thereby rendering the pavement marker highly visible at night, is best illustrated in FIGS. 4, 7, 8 and 9. The lens member 30 is formed of a light-transmitting synthetic resin and includes a substantially planar front face 31 and a rear face 32. As illustrated, the lens member 30 is generally rectangular and is intended to be positioned in the channel provided by the side edges 27, 28 and the support wall 25.

Figure 8:
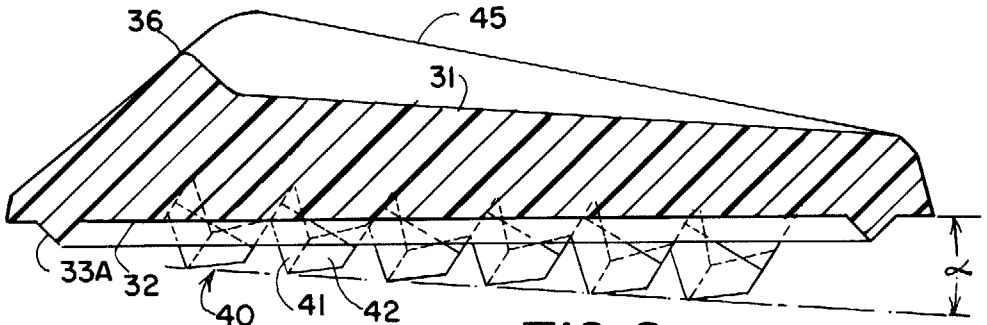
FIG. 8 is a greatly enlarged cross-sectional view of the lens member taken along the line 8—8 in FIG. 4 and rotated approximately 90 degrees.
Figure 9:
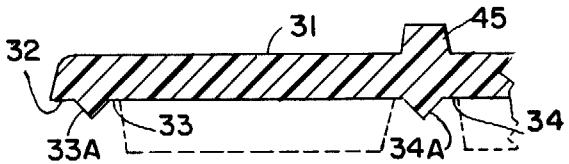
FIG. 9 is an enlarged fragmentary sectional view of the lens member taken along the line 9—9 of FIG. 4.

The rear face 32 of the lens member 30 is provided with a peripheral edge portion 33 which extends about the entire periphery of the lens member 30 (FIG. 4) and includes a portion 33A which is originally in the form of a generally triangular bead (FIGS. 8 and 9). The rear surface 32 further is provided with a plurality of dividing portions 34, the dividing portions 34 intersecting the peripheral edge portion 33 at equally spaced distances therealong, thereby dividing the lens member into a plurality of generally rectangular areas circumscribed by the peripheral edge portion 33 and the dividing portions 34. As illustrated, the dividing portions 34 originally may include a raised triangular sealing bead 34A, and hereinafter, in the specification, for convenience, the dividing portions 34 may be referred to as "dividing ribs".

The lens member 30 is intended to be positioned over the inclined support wall 25 of the base 20 and rigidly secured thereto, preferably by ultrasonic welding. When properly positioned, each of the rectangular areas circumscribed by the peripheral edge portion 33 and dividing portions 34 will coextensively overlie and be in registry with the rectangular-shaped openings of the recesses or pockets 26 formed in the support wall 25, while the dividing portions 34 will overlie the dividing portions 25A of the support wall 25.

When the lens member 30 is ultrasonically welded to the base 20, the sealing beads 33A and 34A become substantially flattened as a result of the energy imparted thereto during the ultrasonic welding process, whereby the peripheral edge portion 33 directly abuts the support wall 25, as best illustrated in FIG. 7, and provides a substantial welded surface area visible through the transparent lens member 30.

Similarly, the dividing ribs 34 will become substantially flattened as they are sealed to the underlying dividing portions 25A of the support wall 25.

The lens member 30 also includes an outwardly extending tab 37 adapted to be positioned within the tab opening 29 on the base 20, and serves as a locator to fix the lens member 30 in position prior to welding.

After welding the lens member 30 to the base 20, each of the dividing wall portions 25A of the support wall 25, and the peripheral portion thereof, in cooperation with the dividing ribs 34 and peripheral edge portion 33, provide a plurality of hermetically sealed cells 35 having a rectangular configuration when viewed in a direction normal to the front face 31.

The pavement marker 10 is provided with a retrodirective cube-corner-type reflector system to effect the signal function of reflecting light back to the driver of an oncoming vehicle whose headlights illuminate the pavement marker.

As best seen in FIG. 4, the rear face of the lens member 30, in those rectangular areas circumscribed by the dividing ribs 34 and peripheral edge portion 33, is configured to provide a plurality of cube-corner-type retrodirective reflector elements 40.

In the embodiments illustrated herein, the cube-corner elements 40 are intended to be generally rectangular when viewed in a direction along the line of the cube axis, as best illustrated in FIG. 4A.

Each of the cube-corner elements 40 includes cooperating faces 41, 42 and 43, respectively, the faces intersecting to form first and second and third dihedral angles in a manner well known to those skilled in the art. In the preferred embodiment illustrated, two of the dihedral angles would be on the order of substantially 90° whereas the third dihedral angle would be formed at an angle significantly different from the first and second dihedral angles, so that the light reflected by such cube-corner element is caused to be diverged to a greater extent in one direction than in the other. One such structure is set forth in greater detail in applicant's U.S. Pat. No. 3,833,285.

In the illustrated embodiment, the different dihedral angle is formed between those faces designated as 41 and 42 in FIG. 4A, whereby the reflectivity of the reflector will be substantially increased at a greater observation angle, as more fully demonstrated hereinafter.

As seen in FIG. 7, the apices of the cube-corner reflective elements 40 extend beyond the peripheral edge portion 33 and the dividing ribs 34, and into the cell 35, when the lens member 30 is secured to the base 20. Although in the embodiment illustrated the cells 35 are substantially large and open, it should of course be understood that the pockets 26 may be recessed less deeply than indicated, and, in fact, the apices of the cube corners 40 may contact the underlying surface 26A defining the interior boundary of the recess 26 thereby further to strengthen the lens member 30 and provide additional support therefor as the lens member is contacted by a tire of an oncoming vehicle.

To facilitate installation of the pavement marker on an underlying roadway surface, or on a metal casting in the event the marker 10 is used in snowplow country, an adhesive impact-absorbing material or pad 15 is secured to the bottom surface 21 of the base 20. The pad 15 may comprise an elastomeric polymeric adhesive material such as, for example, butyl rubber. A protective sheet of release paper 16 is applied to the bottom of the pad. In use, the paper 16 is peeled from the pad 15 and the pavement marker 10 pressed onto the roadway surface. In installation it may be desirable to use a suitanle primer on the roadway to enhance securement of the pavement marker. Satisfactory butyl tape, T-9463, and primer, P-1130, are products of Protective Treatments, Inc. of Dayton, Ohio.

After the pavement is primed, the marker is positioned on the primed road surface with light pressure, after which greater pressure may be applied by driving slowly over the marker with one tire of a service truck. The use of the adhesive pad 15 greatly facilitates installation of the pavement marker 10 on the roadway surface. More particularly, this arrangement permits rapid installation of the pavement markers from a slowly moving vehicle, thereby obviating lane closures and their attendant inconvenience and safety hazards which were necessitated with prior art installation techniques.

It is believed that the impact-absorbing material 15, together with the low profile of the marker 10 achieved by the low height thereof relative to the roadway surface, effects both a reduction and absorption of some of the impact energy normally transmitted through to the underlying pavement surface.

It is also believed that the low profile allows the pavement marker 10 to be ingested by a tire body so that the tire body rolls over the marker 10 and is still partially supported by the roadway surface, rather than causing the full load of the tire to impact upon the marker, which is what is thought to happen with existing markers of a higher elevation. Moreover, it is further believed that the low profile, in combination with the impact-absorbing material 15 on the bottom surface 21 of the base 20, renders the individual cell structure formed by the combined lens member 30 and base 20 more resistant to impact damage.

An important feature of the present invention in leading to a reduction of the overall height of the marker is the provision of the recesses 26 in the support wall 25, rather than by providing the cells in a fashion where the walls are carried by the lens member 30 and extend beyond the apices of the cube corners 40. This feature of the present invention permits reduction in the overall height of the lens member 30, and particularly the elements 40 thereof, relative to the bottom surface of the base 20.

It will be observed with reference to FIG. 8 that the cube-corner elements 40 disposed toward the lower end of the lens member 30 extend outwardly to a greater extent from the rear wall 32 of the lens member 30 than do those reflector elements disposed toward the upper end. The plane defined by the apices of the elements 40 is parallel to the front face 31, but is inclined at an acute angle $\alpha$ to the rear face 32 (FIG. 8). This feature allows a further reduction in overall height of the marker, without requiring undesirable undercuts in the base 20, which otherwise would have to be provided therein if the cube corners 40 at the upper portion of the lens member extended outwardly as far as the lower elements.

As disclosed in applicant's prior '327 patent, there is an optimum balance obtained in maintaining optical effectiveness by limiting abrasion and achieving adequate wiping or cleaning of the front face of the marker upon contact by a moving tire. Such optimum balance is achieved when the angle of the front face of the lens member is disposed at approximately 30° to the horizontal, with a satisfactory result being obtained where such angle is approximately from 15° to 45°. In general, abrasion resistance is directly proportional to the front face angle while self-cleaning ability is inversely proportional to the front face angle.

However, the abrasive action on the front face of the marker due to tire contact becomes an even more critical factor than the aforementioned wiping or cleaning action when the pavement marker is used where abrasive materials are purposely placed on the road. Thus, in an area where salt or sand is put on the road during the wintertime, the wiping action by such abrasive materials in contact between the tire and front face of the lens member causes more serious damage to the front face than is the case where those markers are located in other areas of the country where such abrasive materials are not on the roadway. In order to minimize the loss of reflectivity due to abrasion, and to prolong the reflective qualities of the pavement marker under these conditions, the front surface 31 of the lens member 30 of the present invention is preferably inclined at an angle of 45° relative to the horizontal surface 21 of the base 20. It will be appreciated that the effects of abrasion may be further minimized by increasing the angle of the front face above 45°; however, it is believed that at front face angles above 60°, the cleaning and wiping action by tire contact will be inadequate to maintain optical effectiveness.

It is also known that the front surface reflection loss due to the inherent nature of the material of the lens member itself is less at 45° than at 30°. As an example, the typical front surface reflection loss of a pavement marker in which the front surface of the lens is located at 30° to the horizontal would be approximately 24%, whereas the front surface loss with the reflector at 45° to the horizontal would be only 12%. Also, by inclining the front face of the marker at 45°, there is a smaller area exposed to contact by automobile tire studs or stones carried in the tire treads, and also the pressure on the front surface is reduced. Further, by inclining the front face of the marker at 45°, it is possible to further reduce the overall height of the marker because there will be a lesser inclination of the cube axis relative to the horitonal than is provided in applicant's prior '327 patent, and it will not be necessary to tilt the cube-corner elements 40 as much.

To further protect the front surface 31 from excessive abrasion, and particularly from a grinding action by sand or salt being disposed on the roadways, the front surface 31 of the lens member 30 may be provided with abrasion-limiting means; in the illustrated embodiment such means comprise a plurality of outwardly extending ridges 45. The operation of the ridges 45 is set forth in the copending application of Sidney A. Heenan and Glenn W. Johnson, Jr., entitled "Pavement Marker", Ser. No. 681,860 (Docket SP-883.5), filed Apr. 30, 1976 and in the continuation-in-part thereof, Ser. No. 789,266 now abandoned (SP-883.5A), filed on even date herewith, assigned to the same assignee as the present application, and the disclosures of which are incorporated herein by reference. The ridges 45 are disposed directly over and in alignment with the dividing ribs 34 on the back face 32 of the lens member 30, whereby the ridges 45 do not interfere with the operation of the reflex portions 40 on the lens member. The ridges 45 may be integrally molded with the lens member 30, or, if desired, they could be made of a more abrasion-resistant material than the lens member and thereafter secured to the lens member 30 by welding or adhesive, thereby to provide further protection for the front surface of the marker.

As previously described, the side edges 27 and 28 extend outwardly beyond the inclined support walls 25 of the base 20, and provide a channel between the side edges and the support wall 25 within which is disposed the lens member 30. The side edges 27 and 28 provide further structural support and protection for the lens member 30 adjacent those areas in which the ultrasonic welding occurs at the corners of the marker, thereby serving to substantially protect the integrity of the marker at those points. It will also be noted that the side edges 27–28 and the front edges of the protective ridges 45 lie in the same plane, in effect defining a protective barrier for the front face 31 of the marker 10.

The pavement marker 10 also may be provided with a metal cover plate 19 to overlie and protect the entire top wall 24 thereof, the cover plate 19 also extending beyond and overlying the upper edge of the lens member 30, as best seen in FIG. 3. The metal cover plate 19 is intended to be used on those embodiments of the pavement marker 10 which are to be installed in a metal casting and subjected to possible contact by studded snow tires passing over the top of the marker, the cover plate serving to provide additional protection against such studs.

The cover plate 19 may be adhesively secured to the top wall 24 or, alternatively, a second impact-absorbing pad (not shown) may be fixedly secured therebetween. As the use of tire studs becomes more widely prohibited, the metal plate and recessed channel may be eliminated.

The rectangularly shaped longitudinally extending channel 24A provided in the cover plate 19 and in the top wall 24 is adapted to receive a retaining member in a well-known manner, the retaining member serving to further hold the pavement marker in place on the underlying metal casting, if such retaining member is desired.

The arrangement of the lens member 30 with its peripheral transparent edge portion 33 and dividing ribs 34, and the underlying light-diffusing opaque support wall 25, imparts substantial daytime visibility to the pavement marker 10, rendering it of greater utility than prior markers.

In the illustrated embodiment, the total area occupied by the peripheral edge portion 33 and the dividing ribs 34 is substantially equal to that occupied by the retrodirective reflector elements 40 in those areas circumscribed by the edge portion 33 and the dividing ribs 34.

By using rectangular retrodirective cube-corner elements 40 and rectangular cells 35, maximum use of the area of the lens member 30 is accomplished, as there will be no partial cube-corner elements along the edge of any cell, while at the same time it is possible to substantially completely fill the area circumscribed by the peripheral edge portion 33 and the dividing ribs 34 with retrodirective reflective elements 40.

Further, the use of the rectangular cells 35 and square reflector elements 40 permits the use of vertical side wall surfaces in each recess 26 of the marker, if desired, whereby substantially the full width of the marker 10 is provided with complete reflective elements.

The opaque, light-diffusing base 20 serves to reflect daylight impinging thereon to an observer. At a distance, the uniform spacing of the dividing ribs 34 and dividing wall portions 25A causes the pavement marker to appear as a substantially uniform reflective body, with the cells 35 tending to disappear to the eye of the observer under daylight conditions. Alternatively, under nighttime driving conditions, the uniform size and spacing of the cells 35 causes the pavement marker to appear as a uniform reflective member, the dividing ribs 34, which improve daytime visibility, tending to disappear under evening driving conditions.

To achieve these benefits, together with a low profile, it is believed that the maximum rectangular projected dimensions of each cell 35 should not exceed about 0.3 inches high and about 0.75 inches wide, with the preferred construction providing cells substantially square in projected view with a projected height of approximately 0.3 inches and a projected width of approximately 0.36 inches.

While the preferred embodiment has eight such rectangular cells therein, it is believed that a minimum of five cells is required in order to obtain the substantial daytime reflective qualities achieved by the present marker and to preserve nighttime reflectivity of the marker in the event of damage to one or more of the cells, which would cause it to lose its hermetic seal and thereby ultimately render it optically ineffective.

Despite having at least half of its projected area devoted to wall structure for providing strength and daytime visibility, the pavement marker 10 of the present invention also provides substantially improved reflectivity over that of the '327 patent. As an example, the table set forth herebelow indicates representative figures for typical units of the '327 marker contrasted with the present invention at two different observation angles. It will be observed that a pavement marker of the type of the present invention is almost two and one-half times brighter at a 0.2° observation angle, corresponding to a distance of approximately 500 feet, and almost five times brighter at a 0.4° observation angle, corresponding to a distance of about 250 feet.

REPRESENTATIVE BRIGHTNESS
Candlepower per Footcandle per Square Inch of Reflector

| Observation Angle | 3,332,327 Patent | Present Invention |
|---|---|---|
| .2° | 3 | 8 |
| .4° | 1.5 | 8 |

The increased brightness of the present invention permits the reduction in height of the marker without any loss in specific intensity, as indicated in the table below.

SPECIFIC INTENSITY
Candlepower per Footcandle

| Observation Angle | 3,332,327 Patent | Present Invention |
|---|---|---|
| .2° | 6 | 8 |
| .4° | 3 | 8 |

Moreover, the specific intensity of the present invention is significantly greater at 0.4° observation angle than that of the '327 marker for a smaller area, thereby causing the marker of the present invention, though of a low profile, to be substantially brighter in appearance.

In the embodiment illustrated, the height of the base 20 from the bottom horizontal surface 21 to the top wall 24 is approximately 0.43 inches; the pad 15 is approximately 0.06 inches, for a total height above the roadway of approximately 0.49 inches, as contrasted with the overall height of the pavement marker manufactured in accordance with the '327 patent of approximately 0.72 inches. Moreover, an epoxy adhesive normally was utilized to apply the '327 version pavement marker to the pavement, or, in those instances in which a pad was used, thee would be a further increase in height of the prior marker of up to 0.06 inches. Thus, the present invention represents a reduction of about 38% in overall height.

The front face of the lens member 30 is disposed at an angle of approximately 45° to the horizontal surface 21, while the support wall 25 is inclined at an angle of approximately 41°. The ridges 45 on the front face 31 of the lens member 30 are positioned at angles of approximately 53° relative to the horizontal surface 21 and similarly the side edges 27 and 28 forming extensions of the side walls 22 and 23 also are inclined at angles of approximately 53° relative to the underlying surface 21. It will be apparent from the foregoing that the outer edges of the ridges 45 and the side edges 27 and 28 therefore are substantially coplanar and provide a protective area for the front surface of the lens member.

The base 20 may be made of a thermoplastic resin such as acrylonitrile butadiene styrene (commonly known as ABS), glass-filled ABS, methyl methacrylate or rubber-modified methyl methacrylate (commonly known as Plexiglass DR) or lexan, or may be made of a thermosetting material and be adhesively mounted. The lens may be of methyl methacrylate or a rubber-modified methyl methacrylate or a polycarbonate such as lexan.

Normally, the lens and base will be chosen to provide the same colors, day and night, with the specific color being determined by the specific function of the marker, e.g., delineation vs. median edge delineation.

Figure 10:
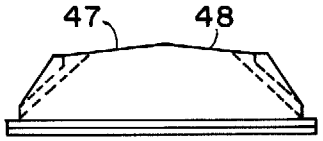
FIG. 10 is an end elevational view of a second embodiment of the pavement marker of the present invention.

The embodiment of the pavement marker illustrated in FIG. 10 is primarily intended to be used independently of any metal housing or casting. In that embodiment the top wall 24, rather than being generally horizontal, as in the first embodiment illustrated in FIG. 1, instead has surfaces 47 and 48 which incline upwardly in the same general direction as the support walls 25, the inclined surfaces 47 and 48 forming a crown above the height of the lens member to provide additional reflective body area for reflecting daylight back to an observer. The metal cover plate 19 would of course not be used with this marker which would preferably be used under non-snowplowable conditions. The added crown at the top of the base 20 increases the overall height of the marker by about another 0.06 inches, whereby the total height of such marker would be approximately 0.55 inches.

Referring now to FIGS. 11, 12 and 16 through 19 of the drawings, there is illustrated another embodiment of the pavement marker of the present invention, generally designated by the numeral 50, and comprising a body or base 60 of an opaque, light-diffusing synthetic resin having mounted thereon two of the lens members 30. The base 60 is substantially solid and is formed as a one-piece member to provide a durable structure capable of withstanding impact forces applied to the pavement marker 50 when it is struck by a tire of an oncoming vehicle. More particularly, the base 60 has a generally horizontal bottom surface 61 having a plurality of generally rectangular molding recesses 62 formed therein for the purpose or preventing sinks or shrink stresses during the molding of the base member 60. The molding openings 62 extend well up into the base 60 and cooperate to define therebetween a plurality of substantially vertically extending partitions or walls 63 and a pair of upstanding opposed side walls 64 and 68 interconnected by a top wall 69 which is peaked or gabled to form two halves each inclined at a slight angle to the plane of the bottom surface 61. There is also provided a pair of inclined support walls 65, respectively disposed at opposite sides of the base 60, and positioned such that in use they will be facing the directions of oncoming vehicles. Each of the support walls 65 has a plurality of recesses 66 formed therein, which recesses have substantially rectangular openings intersecting the plane of the outer surface of the support wall 65, the portions of each of the support walls 65 between the recesses 66 defining septa or dividing portions 67.

The top wall 69 of the base 60 has inclined top surfaces 70 and 71 which respectively extend upwardly from the upper ends of the outer surfaces of the support walls 65 and intersect along a line substantially parallel to the support walls 65 and midway therebetween. Each of the end walls 64 and 68 is provided at the upper end thereof with upstanding shoulders 72 and 73 which respectively project upwardly above the top surfaces 70 and 71 of the top wall 69 and outwardly beyond the outer surfaces of the support walls 65, the shoulders 72 cooperating with one of the support walls 65 to define a channel therealong and the shoulders 73 cooperating with the other of the support walls 65 to define a channel therealong. Preferably, each of the side walls 64 and 68 is also provided with a tab opening 74 therein adjacent to the corresponding inclined support wall 65 for purposes of facilitating the alignment of the lens members 30 during attachment thereof to the base 60.

The lens members 30 were described above in connection with the pavement marker 10, and each of the lens members 30 is mounted on the base 60 and cooperates therewith in the same manner as was described above with respect to the base 20 of the pavement marker 10. More particularly, each of the lens members 30 is positioned over one of the inclined support walls 65 of the base 60 and rigidly secured thereto, as by ultrasonic welding, with the rectangular areas circumscribed by the peripheral edge portion 33 and dividing portions 34 coextensively overlying in registry with the rectangular-shaped openings of the recesses or pockets 66 formed in the support walls 65, while the dividing portions 34 overlie the dividing portions 67 of the support walls 65. When the lens members 30 are ultrasonically welded to the base 60, the sealing beads 33A and 34A become substantially flattened so that the peripheral edge portion 33 directly abuts the support wall 25 and provides a substantial welded surface area visible through the transparent lens members 30. Similarly, the dividing ribs 34 become substantially flattened as they are sealed to the underlying dividing portions 67 of the support walls 65. The tabs 37 are respectively adapted to be positioned within the tab openings 74 of the base 60 and serve to fix the position of the lens members 30 prior to welding. After welding, the lens members 30 cooperate with the associated support walls 65 to provide a plurality of hermetically sealed cells as described above.

It is an important feature of this invention that the dimensions of the molding openings 62 are such that none of the base walls 63, 64, 65, 68 or 69 has a thickness greater than ⅛ inch. The purpose of this arrangement is to minimize molding time, since, in general, the molding time is proportional to the thickness of the members being molded. It has been found that a wall thickness of ⅛ inch corresponds to a molding time of approximately 30 seconds. This reduced molding time considerably reduces the cost of the manufacture of the base 60.

The pavement marker 50 may be installed on the pavement in the same manner as was described above with respect to the pavement marker 10, an adhesive pad 15 of impact-absorbing material being utilized.

The pavement marker 50 is primarily intended to be used independently of any metal housing or casting, the inclined top surfaces 70 and 71 forming a crown above the height of the lens members 30 to provide additional reflective body area for reflecting daylight back to an observer. The metal cover plate 19 would of course not be used with the pavement marker 50, which would preferably be used under non-snowplowable conditions. In a constructional model of the pavement marker 50, the overall height of the marker, including the adhesive pad 15, is approximately 0.62 inches, the outer surfaces of the support walls 65 being inclined at approximately 41° to the surface of the pavement, so that the front face of each of the lens members 30 is inclined at an angle of approximately 45° to the horizontal. In use, the front edges of the ridges 45 of the lens members 30 lie in the same plane as the front edges of the shoulders 72 and 73 of the base 60, in effect defining a protective barrier for the front faces 31 of the lens members 30 in the pavement marker 50.

Referring now also to FIGS. 13 through 15, 20 and 21, there is illustrated another embodiment of the pavement marker of the present invention, generally designated by the numeral 100, and including the base 60 having mounted thereon two lens members, each generally designated by the numeral 80. Each of the lens members 80 is similar in construction to the lens member 30, with the exception that the lens members 80 are not provided with the outwardly extending protective ridges 45. More particularly, the lens member 80 is formed of a light-transmitting synthetic resin and includes a substantially flat front face 31 and a rear face 32. As illustrated, the lens member 80 is generally rectangular and is intended to be positioned in the channel provided by the shoulders 72 and 73 and the support walls 65. The rear face 82 of the lens member 80 is provided with a peripheral edge portion 83 which extends about the entire periphery of the lens member 80 (FIG. 15) and includes a portion 88 which is originally in the form of a generally triangular bead (FIGS. 20 and 21). The rear surface 82 further is provided with a plurality of dividing portions 84, the dividing portions 84 intersecting the peripheral edge portion 83 at equally-spaced distances therealong, thereby dividing the lens member 80 into a plurality of generally rectangular areas circumscribed by the peripheral edge portion 83 and the dividing portions 84. As illustrated, the dividing portions 84 originally may include a raised triangular sealing bead 89, and hereinafter, in the specification the dividing portions 84 may be referred to as "dividing ribs".

The lens member 88 is intended to be positioned over the inclined support wall 65 of the base 60 and rigidly secured thereto, preferably by ultrasonic welding. When properly positioned, each of the rectangular areas circumscribed by the peripheral edge portion 83 and dividing portions 84 will coextensively overlie and be in registry with the rectangular-shaped openings of the recesses or pockets 66 formed in the support wall 65, while the dividing portions 84 will overlie the dividing portions 67 of the support wall 65.

When the lens member 80 is ultrasonically welded to the base 60, the sealing beads 88 and 89 become substantially flattened as a result of the energy imparted thereto during the ultrasonic welding process, whereby the peripheral edge portion 83 directly abuts the support wall 65, as best illustrated in FIG. 19, and provides a substantial welded surface area visible through the transparent lens member 80. Similarly, the dividing ribs 84 will become substantially flattened as they are sealed to the underlying dividing portions 67 of the support wall 65. The lens member 80 also includes an outwardly extending tab 87 adapted to be positioned within the tab opening 74 on the base 60, and serves as a locator to fix the lens member 80 in position prior to welding.

After welding the lens member 80 to the base 60, each of the dividing wall portions 67 of the support wall 65, and the peripheral portion thereof, in cooperation with the dividing ribs 84 and peripheral edge portion 83, provide a plurality of hermetically sealed cells 85, each having a rectangular configuration when viewed in a direction normal to the front face 81.

Figure 15:
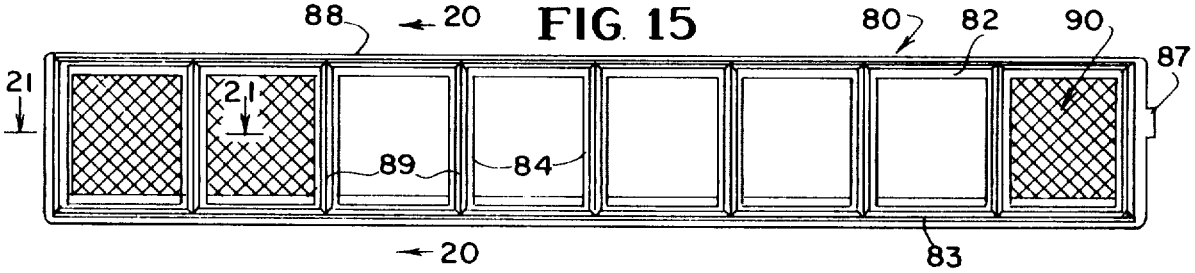
FIG. 15 is an enlarged view of the rear face of a second embodiment of lens member forming a part of the pavement marker of FIG. 13, taken in a direction perpendicular to the rear face thereof.

The lens member 80 is provided with a retrodirective cube-corner-type reflector system to effect the signal function of reflecting light back to the driver of an oncoming vehicle whose headlights illuminate the pavement marker. As best seen in FIGS. 15 and 20, the rear face of the lens member 80, in those rectangular areas circumscribed by the dividing ribs 84 and the peripheral edge portion 83, is configured to provide a plurality of cube-corner-type retrodirective reflector elements 90. The retrodirective reflector elements 90 are diagrammatically illustrated in FIGS. 13 and 15 as a crisscross pattern of lines, but it will be appreciated that these reflector elements may be identical in construction to the reflector elements 40 described above in connection with the lens member 30 in FIGS. 8 and 9.

As seen in FIGS. 19 and 20, the apices of the cube-corner reflector elements 90 extend beyond the peripheral edge portion 83 and the dividing ribs 84, and into the cell 85, when the lens member 80 is secured to the base 60. Since the pavement marker 100 is intended primarily for use independently of a metal housing or casting in non-snowplowable applications, no protective ridges such as the ridges 45 of the lens members 30 are necessary in the lens members 80. But the abrasion resistance of the lens member 80 may be substantially increased by the provision of a layer 95 of protective material such as glass or the like overlying and adhered to the front face 81 of the lens member 80. Preferably, the glass layer 95 has a thickness of approximately 0.005 inches and is secured by a layer of suitable adhesive material of between about 0.006 and 0.012 inch thick to the front face 81 so as substantially to cover all of the portions of the front face 81 which overlie the retrodirective cub-corner reflector elements 90 of the lens member 80. It has been found that the use of this glass layer 95 has dramatically increased the abrasion resistance of the lens member 90, as is more fully explained in the aforementioned copending application Ser. No. 681,860 now abandoned of Messrs. Heenan and Johnson, Jr., and the continuation-in-part thereof, Ser. No. 789,266 now abandoned (Docket SP-883.5A), filed on even date herewith. The use of the glass overlay significantly reduces the degradation of the brightness of the lens member 80 as a result of normal wear in service.

Also, the arrangement of the lens member 80 with its peripheral transparent edge portion 83 and dividing ribs 84, and the underlying light-diffusing opaque support wall 65, imparts substantial daytime visibility to the pavement marker 100, rendering it of greater utility than prior markers. The opaque, light-diffusing base 60 serves to reflect daylight impinging thereon to an observer and, at a distance, the uniform spacing of the dividing ribs 84 and dividing wall portions 67 causes the pavement marker 100 to appear as a substantially uniform reflective body, with the cells 85 tending to disappear to the eye of the observer under daylight conditions.

The base 60 and the lens members 80 may respectively be constructed of any of the materials set forth above with respect to the base 20 and lens members 30, but preferably the base 60 and lens members 80 are both formed of a rubber-modified methyl methacrylate such as that sold under the trademark "PLEXIGLAS DR".

PLEXIGLAS DR, because it is rubber modified, gives higher impact resistance than unmodified Plexiglas, but reportedly it is a softer material than the unmodified Plexiglas. Because of this, it was expected that PLEXIGLAS DR would not prove sufficiently abrasion resistant for use in pavement markers. Surprisingly, pavement markers of the character disclosed herein molded of PLEXIGLAS DR proved to be as abrasion resistant as those of unmodified Plexiglas.

Figure 22:
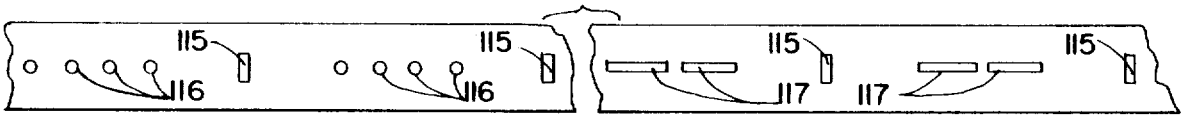
FIG. 22 is a diagrammatic view of a roadway illustrating prior art arrangements of pavement markers utilizing different types of pavement markers for daytime and nighttime visibility.

Thus, the pavement markers of the present invention have very great daytime as well as nighttime visibility, as well as being substantially cheaper to manufacture than prior pavement markers. This affords substantial advantages and economies in application of the pavement markers. More particularly, referring to FIG. 22, there is illustrated a prior art arrangement of pavement markers as a lane marking on a roadway 110. This typical arrangement includes a combination of daytime and nighttime markers substantially equidistantly spaced apart, and arranged so that there are about four daytime markers 116 (such as the so-called "Botts Dots") or 117 (such as painted stripes) between every two nighttime markers 115. The nighttime markers 115 may, for example, be of the type of retrodirective reflector markers disclosed in the aforementioned U.S. Pat. No. 3,332,327, which markers have a high nighttime visibility over a substantial distance and, therefore, can be widely separated on the pavement. But these prior art nighttime pavement markers 115 have a relatively low daytime visibility. Therefore, the Botts Dots 116 or the painted stripes 117 are typically utilized at their normal spacings between the nighttime markers 115 to achieve the necessary visibility both in daylight and at night.

Figure 23:
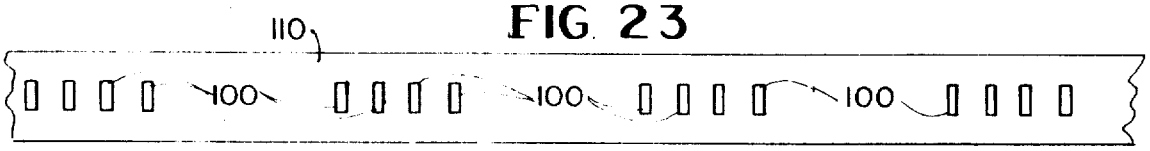
FIG. 23 is a view similar to FIG. 22, illustrating an arrangement of pavement markers utilizing only the pavement markers of the present invention for both daytime and nighttime visibility.

But the daytime visibility of the pavement markers of the present invention is so superior to that of the prior art markers 115 that they can be utilized effectively as both daytime and nighttime markers and can, therefore, be utilized in lieu of the prior type daytime markings at the normal marker spacings on the pavement, as illustrated in FIG. 23. This offers several significant advantages. First of all, since only one type of pavement marker is utilized in this arrangement, only one type of application equipment need be used, thereby reducing the time and expense of installation. Moreover, fewer total markers for the same distance are needed—four instead of five or eight instead of nine—depending upon state requirements. There are additional safety benefits, because the system of pavement markers of the present invention requires no lane closures and requires less frequent installation than the prior art arrangement illustrated in FIG. 22. Furthermore, the pavement markers of the present invention have been found to have better daylight visibility in the rain than the painted lines 117 of the prior art systems. Finally, the system has added safety benefits over present installations because the same pattern of reflected signals appears to the motorist under day and night driving conditions.

The above detailed description is provided by way of example only. Various details of design and construction may be modified without departing from the true spirit and scope of the invention as defined in the appended claims.

What is claimed is:

1. A low-profile pavement marker for providing a marking signal on a roadway surface capable of reflecting daylight falling thereon and for reflecting light back toward the source thereof so as to be visible to a driver in an oncoming vehicle, said pavement marker comprising: a substantially solid base of an opaque, light-diffusing synthetic resin having a generally horizontal bottom surface; said base having at least one support wall positioned in use in the direction of an oncoming vehicle, said wall having a plurality of inwardly extending recesses therein; a lens member of light-transmitting synthetic resin rigidly secured to said base, said lens member having a generally planar front face being so oriented as to make an acute angle of between about 15° and about 60° with said bottom surface to rise above the roadway surface upon which the pavement marker is to be installed; said lens member having a peripheral edge portion and a plurality of dividing portions intersecting said edge portion and dividing said lens member into a plurality of areas overlying and coextensive with said recesses formed in said support wall, said dividing portions and said edge portion being sealed to said support wall, thereby to provide a plurality of independent and hermetically sealed cells; said lens member having a plurality of retrodirective cube-corner-type reflector elements formed therein and extending beyond said dividing portions and said edge portion and into said cells, said reflector elements being oriented to reflect light falling upon said front face of said lens member in the areas thereof corresponding to said cells back toward the source thereof to render said reflector structure highly visible at night; said base, and said support wall and said lens member in the areas corresponding to said dividing portions and said edge portion providing a reflector surface for reflecting daylight falling upon said marker to render said marker highly visible in daylight.

2. The pavement marker set forth in claim 1, wherein the specific brightness of said pavement marker is 8 candlepower per footcandle per square inch of projected area for observation angles in the range of 0.2° to 0.4°.

3. The pavement marker set forth in claim 1, wherein the specific intensity of said pavement marker is at least 3.0 candlepower per footcandle for observation angles in the range of 0.2° to 0.4°.

4. The pavement marker set forth in claim 1, wherein said base and said lens member are formed of a rubber-modified methyl methacrylate material.

5. A reflex reflector comprising: a body member, said body member including a surface having a plurality of separate recesses therein; and a transparent light-transmitting lens member having a front face and a rear face, said rear face of said lens member having discrete groups of reflex-reflecting elements thereon and extending therefrom, said lens member being affixed to said body member with said rear surface of said lens member being in contact with said body member surface and each of said groups of reflex-reflecting elements extending into and being received by a corresponding one of said recesses to form a plurality of discrete reflex-reflector zones capable of reflecting light impinging upon said front face of said lens member back toward the source thereof.

6. The reflex reflector set forth in claim 5, wherein said reflex-reflecting elements are of the cube-corner type.

7. The reflex reflector set forth in claim 6, wherein said recesses are generally rectangular when viewed in a direction perpendicular to the front face of said lens member, said cube-corner elements substantially completely filling the rear face of said lens member in the areas corresponding to said recesses.

8. The reflex reflector set forth in claim 7, wherein said cube-corner elements are generally rectangular when viewed parallel to their cube axes.

9. The reflex reflector set forth in claim 5, wherein said body member is formed of an opaque, light-diffusing synthetic resin whereby the areas of said body member covered by said transparent lens member not occupied by said reflex-reflecting elements reflect daylight impinging upon the front fact of said lens member.

10. The reflex reflector set forth in claim 5, wherein said lens member is formed of a rubber-modified methyl methacrylate material.

11. The reflex reflector set forth in claim 5, wherein said body member is formed of a rubber-modified methyl methacrylate material.

12. The reflex reflector set forth in claim 5, wherein said lens member and said body member are formed of a rubber-modified methyl methacrylate material.

13. A low-profile pavement marker for providing a marking signal on a roadway surface capable of reflecting daylight falling thereon so as to be visible to a driver in an oncoming vehicle, said pavement marker comprising: a substantially solid base of an opaque, light-diffusing synthetic resin having a generally horizontal bottom surface; said base member having at least one support wall positioned in use in the direction of an oncoming vehicle, said support wall having a plurality of inwardly extending generally rectangular recesses therein; a lens member of light-transmitting synthetic resin rigidly secured to aid base, said lens member having a generally planar front face being so oriented as to make an acute angle of between 15° and 60° with said bottom surface of the base to rise above the roadway surface upon which the pavement marker is to be installed; said lens member having an inwardly extending peripheral edge portion and a plurality of dividing portions intersecting said edge portion and dividing said body member into a plurality of rectangular areas overlying and coextensive with said rectangular recesses, said dividing portions and said edge portion being sealed to said support wall thereby to provide a plurality of independent and hermetically sealed generally rectangular cells, said lens member having a plurality of retrodirective rectangular cube-corner-type reflector elements formed therein and extending inwardly beyond said dividing portions and said edge portion and into said cells, said reflector elements being oriented to reflect light falling upon said front face of said lens member in the areas thereof corresponding to said cells back toward the source thereof to render said reflector structure highly visible at night, said opaque light-diffusing base, and said support wall and said lens member in the areas corresponding to said dividing portions and said edge portion, providing a reflector surface for reflecting daylight falling upon said marker to render said marker highly visible in daylight, an adhesive impact-absorbing material fixedly secured to said bottom face of said base for fixedly securing said pavement marker to an underlying support surface, the height of said pavement marker being not in excess of about 0.55 inches, whereby said reduced height and impact-absorbing material cooperate to reduce the impact energy imparted to said marker and underlying roadway.

14. A low-profile pavement marker for providing a marking signal on a roadway surface capable of reflecting light impinging thereon so as to be visible to a driver in an oncoming vehicle, said pavement marker comprising: a substantially solid base of synthetic resin having a generally horizontal bottom surface; a lens member of light-transmitting synthetic resin secured to said base, said lens member having a generally planar front face being so oriented as to make an acute angle of between 15° and 60° with said bottom surface of the base to rise above the roadway surface upon which the pavement marker is to be installed; said lens member having a plurality of retrodirective cube-corner-type reflector elements formed therein, said reflector elements being oriented to reflect light impinging upon said front face of said lens member back toward the source thereof to render said reflector structure highly visible at night; and an adhesive impact-absorbing material secured to said bottom surface of said base for fixedly securing said pavement marker to an underlying support surface, the height of said pavement marker being not in excess of about 0.55 inches, whereby said reduced height and impact-absorbing material cooperate to reduce the impact energy imparted to said marker and underlying roadway.

15. The pavement marker set forth in claim 14, wherein said base and said lens member are formed of a rubber-modified methyl methacrylate material.

16. The pavement marker set forth in claim 14, wherein said lens member is formed of a rubber-modified methyl methacrylate material.

17. The pavement marker set forth in claim 14, wherein said base is formed of a rubber-modified methyl methacrylate material.

* * * * *